US007908699B2

(12) United States Patent
Hohlbein et al.

(10) Patent No.: US 7,908,699 B2
(45) Date of Patent: Mar. 22, 2011

(54) ORAL CARE IMPLEMENT

(75) Inventors: Douglas J. Hohlbein, Hopewell, NJ (US); Thomas Mintel, Rahway, NJ (US); Armin Baertschi, Winznau (CH)

(73) Assignee: Colgate-Palmolive Company, New York, NY (US)

( * ) Notice: Subject to any disclaimer, the term of this patent is extended or adjusted under 35 U.S.C. 154(b) by 932 days.

(21) Appl. No.: 11/019,685

(22) Filed: Dec. 23, 2004

(65) Prior Publication Data

US 2005/0210612 A1 Sep. 29, 2005

Related U.S. Application Data

(63) Continuation-in-part of application No. 10/869,922, filed on Jun. 18, 2004, now Pat. No. 7,143,462, which is a continuation-in-part of application No. 10/601,106, filed on Jun. 20, 2003, now abandoned, which is a continuation-in-part of application No. PCT/US03/030633, filed on Sep. 26, 2003, which is a continuation-in-part of application No. PCT/US03/029497, filed on Sep. 17, 2003, which is a continuation-in-part of application No. 29/189,729, filed on Sep. 10, 2003, now Pat. No. Des. 517,812, which is a continuation-in-part of application No. 10/109,637, filed on Apr. 1, 2002, which is a continuation-in-part of application No. 29/148,074, filed on Sep. 14, 2001, now Pat. No. Des. 456,139, which is a continuation-in-part of application No. 09/897,606, filed on Jul. 3, 2001, now Pat. No. 6,442,787.

(60) Provisional application No. 60/414,117, filed on Sep. 27, 2002, provisional application No. 60/418,776, filed on Oct. 16, 2002, provisional application No. 60/419,425, filed on Oct. 18, 2002, provisional application No. 60/412,290, filed on Sep. 20, 2002.

(51) Int. Cl.
*A61B 17/24* (2006.01)
*A61H 13/00* (2006.01)
*A46B 9/04* (2006.01)

(52) U.S. Cl. ..... 15/110; 15/111; 15/167.1; 15/188; 601/141; 606/161

(58) Field of Classification Search ..... 15/110, 15/111, 167.1, 188; 601/139, 141; 606/161
See application file for complete search history.

(56) References Cited

U.S. PATENT DOCUMENTS 301,644 A 7/1884 Thompson
(Continued)

FOREIGN PATENT DOCUMENTS

CA 2004029 5/1990
(Continued)

OTHER PUBLICATIONS

"The Integral Hinge," "Poly-Pro" Polypropylene, Spencer Chemical Co., 1963.

(Continued)

*Primary Examiner* — Mark Spisich
(74) *Attorney, Agent, or Firm* — Judy W. Chung

(57) ABSTRACT

An oral care implement with a handle includes a head with a tissue cleanser. The tissue cleanser may be a pad composed of an elastomeric material. The pad is disposed on the head on a surface opposite the tooth cleaning elements. The tissue cleanser may include a plurality of nubs extending for cleaning between the papillae of the tongue. The tissue cleanser may include a plurality of conically shaped nubs. A tissue cleanser can be used to reduce oral malodor problems and remove oral epithelial cells.

2 Claims, 10 Drawing Sheets

U.S. PATENT DOCUMENTS

| | | | |
|---|---|---|---|
| 585,358 | A | 6/1897 | Gould |
| 697,336 | A | 4/1902 | Hagerty |
| 726,727 | A | 4/1903 | Mills |
| 758,764 | A | 5/1904 | Macleod |
| 759,490 | A | 5/1904 | Yates |
| 803,995 | A | 11/1905 | Davenport |
| 864,054 | A | 8/1907 | Abrams |
| 907,842 | A | 12/1908 | Meuzies |
| 914,501 | A | 3/1909 | McEachem |
| 958,371 | A | 5/1910 | Danek |
| 1,002,468 | A | 9/1911 | Strangman |
| 1,006,630 | A | 10/1911 | Clarke |
| 1,007,328 | A | 10/1911 | Brandstetter |
| 1,022,920 | A | 4/1912 | Anderson |
| 1,125,532 | A | 1/1915 | Himmel |
| 1,128,139 | A | 2/1915 | Hoffman |
| 1,132,326 | A | 3/1915 | Fouyer |
| 1,142,698 | A | 6/1915 | Crumbaugh |
| 1,153,409 | A | 9/1915 | Wheeler |
| 1,191,556 | A | 7/1916 | Blake |
| 1,251,250 | A | 12/1917 | Libby |
| 1,268,544 | A | 6/1918 | Cates |
| 1,327,757 | A | 1/1920 | Eggers |
| 1,327,807 | A | 1/1920 | Burleigh |
| 1,369,966 | A | 3/1921 | Cosens et al. |
| 1,405,279 | A | 1/1922 | Cassedy |
| 1,466,723 | A | 9/1923 | Izawa |
| 1,470,710 | A | 10/1923 | Davis |
| 1,495,675 | A | 5/1924 | Colt |
| 1,588,785 | A | 6/1926 | Van Sant |
| 1,598,224 | A | 8/1926 | Van Sant |
| 1,639,880 | A | 8/1927 | Butler |
| 1,658,706 | A | 2/1928 | Carrott |
| D75,971 | S | 8/1928 | Faubert et al. |
| 1,704,564 | A | 3/1929 | Friedland |
| 1,705,109 | A | 3/1929 | Essbach |
| 1,728,956 | A | 9/1929 | Darmitzel |
| 1,741,143 | A | 12/1929 | Chin |
| 1,796,641 | A | 3/1931 | Zimmerman et al. |
| 1,816,582 | A | 7/1931 | Heron |
| 1,817,585 | A | 8/1931 | Samuel |
| 1,833,555 | A | 11/1931 | Bell et al. |
| D87,072 | S | 5/1932 | Pfleger |
| 1,860,924 | A | 5/1932 | Cooke |
| 1,861,347 | A | 5/1932 | Johnson |
| 1,872,832 | A | 8/1932 | Silverberg |
| 1,891,864 | A | 12/1932 | Barrett |
| 1,892,068 | A | 12/1932 | Metzler |
| 1,903,161 | A | 3/1933 | Barkan |
| 1,924,152 | A | 8/1933 | Coney et al. |
| 1,927,365 | A | 9/1933 | Frollo |
| 1,928,328 | A | 9/1933 | Carpentier |
| 1,976,271 | A | 10/1934 | Vachoux |
| 1,993,662 | A | 3/1935 | Green |
| 1,993,763 | A | 3/1935 | Touchstone |
| 2,003,243 | A | 5/1935 | Campbell et al. |
| 2,028,011 | A | 1/1936 | Raymond |
| D99,352 | S | 4/1936 | Grapp |
| 2,042,239 | A | 5/1936 | Planding |
| 2,049,956 | A | 8/1936 | Greenberg |
| 2,059,914 | A | 11/1936 | Rosenberg |
| 2,079,728 | A | 5/1937 | Arnold |
| 2,083,217 | A | 6/1937 | Brothers et al. |
| 2,097,987 | A | 11/1937 | Phillips |
| 2,117,174 | A | 5/1938 | Jones |
| 2,129,082 | A | 9/1938 | Byrer |
| 2,139,245 | A | 12/1938 | Ogden |
| 2,161,349 | A | 6/1939 | Hadden |
| 2,186,005 | A | 1/1940 | Casto |
| 2,196,284 | A | 4/1940 | Ackerman |
| 2,209,173 | A | 7/1940 | Russell |
| D122,815 | S | 10/1940 | Crosby |
| 2,218,072 | A | 10/1940 | Runnels |
| 2,225,331 | A | 12/1940 | Campbell |
| 2,233,936 | A | 3/1941 | Campbell |
| 2,253,210 | A | 8/1941 | Psiharis |
| 2,253,910 | A | 8/1941 | Luenz |
| 2,254,365 | A | 9/1941 | Griffith et al. |
| 2,262,982 | A | 11/1941 | Wolcott |
| 2,263,802 | A | 11/1941 | Grusin |
| 2,266,195 | A | 12/1941 | Hallock |
| 2,305,461 | A | 12/1942 | Spvra |
| 2,312,828 | A | 3/1943 | Adamsson |
| 2,326,632 | A | 8/1943 | Friedman |
| 2,364,205 | A | 12/1944 | Fuller |
| 2,405,029 | A | 7/1946 | Gallanty et al. |
| 2,418,485 | A | 7/1947 | Shipley |
| 2,438,268 | A | 3/1948 | Bressler |
| 2,443,297 | A | 6/1948 | Bressler |
| 2,491,274 | A | 12/1949 | McNeill |
| 2,512,059 | A | 6/1950 | Haeusser |
| 2,543,999 | A | 3/1951 | Voss |
| D162,941 | S | 4/1951 | Ehrman |
| 2,554,777 | A | 5/1951 | Dangin |
| 2,574,654 | A | 11/1951 | Moore |
| 2,583,750 | A | 1/1952 | Runnels |
| 2,631,320 | A | 3/1953 | Bressler |
| 2,634,722 | A | 4/1953 | Jackson |
| 2,637,870 | A | 5/1953 | Cohen |
| 2,642,604 | A | 6/1953 | Ferrari |
| 2,650,383 | A | 9/1953 | Bressler |
| 2,651,068 | A | 9/1953 | Seko |
| 2,676,350 | A | 4/1954 | Bressler |
| 2,685,703 | A | 8/1954 | Dellenbach |
| 2,686,325 | A | 8/1954 | Silver |
| 2,702,914 | A | 3/1955 | Kittle et al. |
| 2,708,762 | A | 5/1955 | Kling et al. |
| 2,796,620 | A | 6/1957 | Bressler |
| 2,797,424 | A | 7/1957 | Olson |
| 3,103,027 | A | 9/1963 | Birch |
| 3,103,680 | A | 9/1963 | Krichmar |
| 3,152,349 | A | 10/1964 | Brennesholtz |
| 3,153,800 | A | 10/1964 | Trotin |
| 3,174,174 | A | 3/1965 | Dengler |
| 3,181,193 | A | 5/1965 | Nobles et al. |
| 3,185,001 | A | 5/1965 | Viator |
| 3,188,672 | A | 6/1965 | Gary |
| 3,195,537 | A | 7/1965 | Blasi |
| 3,230,562 | A | 1/1966 | Birch |
| 3,242,516 | A | 3/1966 | Cantor |
| 3,253,292 | A | 5/1966 | Herschensohn |
| 3,254,356 | A | 6/1966 | Yao et al. |
| 3,258,805 | A | 7/1966 | Rossnan |
| 3,320,225 | A | 5/1967 | Bradbury |
| 3,337,893 | A | 8/1967 | Fine et al. |
| 3,398,421 | A | 8/1968 | Rashbaum |
| D213,669 | S | 4/1969 | Miller |
| 3,509,874 | A | 5/1970 | Stillman |
| 3,553,759 | A | 1/1971 | Kramer et al. |
| 3,584,795 | A | 6/1971 | Baird |
| 3,599,916 | A | 8/1971 | Szabo |
| 3,610,043 | A | 10/1971 | Wemyss |
| 3,633,237 | A | 1/1972 | Bagube |
| 3,643,282 | A | 2/1972 | Lechene et al. |
| 3,722,020 | A | 3/1973 | Hills |
| D226,942 | S | 5/1973 | Okuda |
| 3,739,419 | A | 6/1973 | Natman et al. |
| 3,900,550 | A | 8/1975 | Oliver |
| 4,121,798 | A | 10/1978 | Schumacher et al. |
| D255,511 | S | 6/1980 | Hill et al. |
| D258,143 | S | 2/1981 | Flick |
| 4,274,174 | A | 6/1981 | Ertel |
| 4,277,862 | A | 7/1981 | Weideman |
| 4,288,883 | A | 9/1981 | Dolinsky |
| 4,299,208 | A | 11/1981 | Blanc |
| 4,328,604 | A | 5/1982 | Adams |
| 4,356,585 | A | 11/1982 | Protell et al. |
| 4,364,142 | A | 12/1982 | Pangle |
| 4,369,284 | A | 1/1983 | Chen |
| D272,683 | S | 2/1984 | Stocchi |
| D272,687 | S | 2/1984 | Stocchi |
| D272,689 | S | 2/1984 | Stocchi |
| D272,690 | S | 2/1984 | Stocchi |
| D273,635 | S | 5/1984 | Stocchi |
| 4,455,704 | A | 6/1984 | Williams |
| 4,461,285 | A | 7/1984 | Courtin |
| 4,488,327 | A | 12/1984 | Snider |

4,488,328 A 12/1984 Hyman
4,520,526 A 6/1985 Peters
4,535,014 A 8/1985 Wright
4,543,679 A 10/1985 Rosofsky et al.
4,563,381 A 1/1986 Woodland
4,566,145 A 1/1986 Wachtel
4,608,968 A 9/1986 Rosofsky
4,609,171 A 9/1986 Matsui
4,610,043 A 9/1986 Vezjak
4,618,213 A 10/1986 Chen
4,628,564 A 12/1986 Youssef
4,654,922 A 4/1987 Chen
4,691,405 A 9/1987 Reed
4,712,266 A 12/1987 Yamaki
4,712,267 A 12/1987 Cheng
D295,695 S 5/1988 Golzari
4,757,570 A 7/1988 Haeusser et al.
4,800,608 A 1/1989 Key
4,827,551 A 5/1989 Maser et al.
4,829,621 A 5/1989 Phenegar
4,852,832 A 8/1989 Delaney
4,888,844 A 12/1989 Maggs
4,901,212 A 2/1990 Prickett
D309,528 S 7/1990 Valenti
5,001,803 A 3/1991 Discko, Jr.
5,005,246 A 4/1991 Yen-Hul
5,027,796 A 7/1991 Linzey
5,032,082 A 7/1991 Herrera
5,040,260 A 8/1991 Michaels
5,052,071 A 10/1991 Halm
5,054,154 A 10/1991 Schiffer et al.
5,067,061 A 11/1991 Prickett
5,070,567 A 12/1991 Holland
5,114,214 A 5/1992 Barman
5,120,225 A 6/1992 Amit
5,121,894 A 6/1992 Twork, Sr. et al.
5,141,192 A 8/1992 Adams
5,165,761 A 11/1992 Dirksing
5,176,427 A 1/1993 Weihrauch
D335,579 S 5/1993 Chuang
5,226,197 A 7/1993 Nack et al.
5,230,118 A 7/1993 Chamma
5,242,235 A 9/1993 Li
5,249,327 A 10/1993 Hing
D340,808 S 11/1993 Sherman et al.
5,262,468 A 11/1993 Chen
5,269,038 A 12/1993 Bradley
5,273,425 A 12/1993 Hoagland
D345,256 S 3/1994 Khin
5,305,489 A 4/1994 Lage
5,311,414 A 5/1994 Branham, Sr.
5,323,504 A 6/1994 McCusker
5,336,708 A 8/1994 Chen
5,339,482 A 8/1994 Desimone et al.
D350,851 S 9/1994 Spence, Jr.
5,351,358 A 10/1994 Larrimore
5,353,460 A 10/1994 Bauman
5,360,026 A 11/1994 Klinkhammer
5,371,915 A 12/1994 Key
5,373,602 A 12/1994 Bang
5,392,483 A 2/1995 Heinzelman et al.
5,393,796 A 2/1995 Halberstadt et al.
5,396,678 A 3/1995 Bredall et al.
5,398,366 A 3/1995 Bradley
5,398,369 A 3/1995 Heinzelman et al.
5,416,942 A 5/1995 Baldacci et al.
5,438,726 A 8/1995 Leite
5,445,825 A 8/1995 Copelan et al.
5,465,450 A 11/1995 Humphries
5,483,722 A 1/1996 Scheier et al.
5,497,526 A 3/1996 Klinkhammer
5,502,930 A 4/1996 Burkette
5,504,959 A 4/1996 Yukawa et al.
5,508,334 A 4/1996 Chen
5,511,273 A 4/1996 Carroll
5,511,277 A 4/1996 Simonds
D371,680 S 7/1996 Juhlin et al.
5,530,981 A 7/1996 Chen
5,535,474 A 7/1996 Salazar
D375,206 S 11/1996 Halm
5,570,487 A 11/1996 Schneider
D376,695 S 12/1996 Tveras
5,584,690 A 12/1996 Maassarani
5,604,951 A 2/1997 Shipp
5,607,230 A 3/1997 Protz, Jr.
5,613,262 A 3/1997 Choy-Maldonado
5,618,882 A 4/1997 Hammond et al.
5,625,916 A 5/1997 McDougall
5,628,082 A 5/1997 Moskovich
5,630,244 A 5/1997 Chang
5,633,286 A 5/1997 Chen
5,639,049 A 6/1997 Jennings et al.
5,651,158 A 7/1997 Halm
5,673,452 A 10/1997 Chang et al.
5,673,454 A 10/1997 Quintanilla et al.
D386,313 S 11/1997 Moskovich
D386,905 S 12/1997 Brady et al.
5,709,004 A 1/1998 Paduano et al.
D390,706 S 2/1998 Hohlbein et al.
D391,769 S 3/1998 Kling et al.
5,735,011 A 4/1998 Asher
5,735,012 A 4/1998 Heinzelman et al.
5,735,864 A 4/1998 Heisinger, Jr.
5,742,972 A 4/1998 Bredall
5,758,380 A 6/1998 Vrignaud
5,758,383 A 6/1998 Hohlbein
5,765,252 A 6/1998 Carr
5,766,193 A 6/1998 Millner
D396,288 S 7/1998 Samuel
5,774,923 A 7/1998 Halm
5,778,475 A 7/1998 Garcia
5,778,476 A 7/1998 Squillaci et al.
5,779,654 A 7/1998 Foley et al.
5,781,958 A 7/1998 Meessmann et al.
D397,219 S 8/1998 Rangel et al.
5,792,159 A 8/1998 Amin
5,799,354 A 9/1998 Amir
5,802,656 A 9/1998 Dawson et al.
5,810,856 A 9/1998 Tveras
D399,349 S 10/1998 Barth
5,816,687 A 10/1998 Tapp
5,817,114 A 10/1998 Anderson et al.
5,818,856 A 10/1998 Injeyan et al.
5,823,655 A 10/1998 Brooks
RE35,941 E 11/1998 Stansbury, Jr.
D401,069 S 11/1998 Lamond et al.
5,836,030 A 11/1998 Hazeu et al.
5,836,033 A 11/1998 Berge
D402,116 S 12/1998 Magloff et al.
5,842,247 A 12/1998 Decesare
5,845,358 A 12/1998 Woloch
5,848,838 A 12/1998 Presta
D403,510 S 1/1999 Menke et al.
D404,205 S 1/1999 Hohlbein
D404,206 S 1/1999 Hohlbein
5,860,183 A 1/1999 Kam
D405,272 S 2/1999 Khalaj et al.
D407,221 S 3/1999 Van Gelder
D407,222 S 3/1999 Van Gelder
D407,223 S 3/1999 Van Gelder
5,875,510 A 3/1999 Lamond et al.
5,896,614 A 4/1999 Flewitt
5,913,346 A 6/1999 Narwani
5,915,433 A 6/1999 Hybler
D412,064 S 7/1999 Achepohl et al.
5,920,941 A 7/1999 Iannotta
5,926,901 A 7/1999 Tseng et al.
5,928,254 A 7/1999 Jensen
5,930,860 A 8/1999 Shipp
5,938,673 A 8/1999 DePierro et al.
D413,728 S 9/1999 Waguespack et al.
5,946,758 A 9/1999 Hohlbein et al.
5,946,759 A 9/1999 Cann
5,951,578 A 9/1999 Jensen
5,957,942 A 9/1999 Yudelman
5,967,152 A 10/1999 Rimkus
5,970,564 A 10/1999 Inns et al.
D416,685 S 11/1999 Overthun 5,974,614 A 11/1999 Ross
5,980,541 A 11/1999 Tenzer
5,980,542 A 11/1999 Saldivar
5,984,935 A 11/1999 Welt et al.
5,991,958 A 11/1999 Hohlbein
6,004,334 A 12/1999 Mythen
D418,979 S 1/2000 Moskovich et al.
D418,981 S 1/2000 Cheong et al.
D419,304 S 1/2000 Moskovich et al.
6,015,293 A 1/2000 Rimkus
D419,773 S 2/2000 Beals et al.
D420,515 S 2/2000 Van Gelder
D420,802 S 2/2000 Cheong et al.
D420,804 S 2/2000 Juhlin et al.
D421,841 S 3/2000 Achepohl et al.
D421,844 S 3/2000 Stark et al.
6,032,313 A 3/2000 Tsang
6,032,315 A 3/2000 Liebel
6,041,467 A 3/2000 Roberts et al.
D422,413 S 4/2000 Goldinger et al.
6,049,936 A 4/2000 Holley
6,050,709 A 4/2000 Hastings
D423,785 S 5/2000 Karallis
D423,786 S 5/2000 Zelinski
D423,787 S 5/2000 Musciano
D424,808 S 5/2000 Beals et al.
D424,809 S 5/2000 Bernard
D425,306 S 5/2000 Beals et al.
6,058,541 A 5/2000 Masterman et al.
6,073,299 A 6/2000 Hohlbein
D427,437 S 7/2000 Vonarburg
D428,702 S 8/2000 Van Gelder
6,098,233 A 8/2000 Chen
6,105,191 A 8/2000 Chen et al.
6,108,851 A 8/2000 Bredall et al.
6,108,869 A 8/2000 Meessmann et al.
6,119,296 A 9/2000 Noe et al.
6,131,228 A 10/2000 Chen et al.
6,151,745 A 11/2000 Roberts et al.
D434,906 S 12/2000 Beals et al.
6,171,323 B1 1/2001 Potti et al.
D437,486 S 2/2001 Francos
D439,412 S 3/2001 Volpenhein et al.
6,205,611 B1 3/2001 Vigil
D440,767 S 4/2001 Moskovich et al.
6,237,178 B1 5/2001 Krammer et al.
D443,142 S 6/2001 Harada
6,254,390 B1 7/2001 Wagner
6,260,227 B1 7/2001 Fulop et al.
D447,238 S 8/2001 Tang
6,276,021 B1 8/2001 Hohlbein
D448,174 S 9/2001 Harris et al.
6,289,545 B1 9/2001 Molster
D448,569 S 10/2001 Harris et al.
6,298,516 B1 10/2001 Beals et al.
6,308,358 B2 10/2001 Gurber et al.
D450,457 S 11/2001 Hohlbein
6,311,358 B1 11/2001 Soetewey et al.
6,314,606 B1 11/2001 Hohlbein
6,319,332 B1 11/2001 Gavney, Jr. et al.
6,322,573 B1 11/2001 Murayama
D452,615 S 1/2002 Cheong et al.
6,338,460 B1 1/2002 Rumpel
D453,270 S 2/2002 Choong
6,345,405 B1 2/2002 Brackin
D453,998 S 3/2002 Ping
D454,252 S 3/2002 Lee
6,352,545 B1 3/2002 Wagner
6,353,958 B2 3/2002 Welhrauch
6,360,398 B1 3/2002 Wiegner et al.
RE37,625 E 4/2002 Wieder et al.
D456,139 S 4/2002 Hohlbein
6,374,448 B2 4/2002 Seifert
D456,607 S 5/2002 Carlucci et al.
D457,323 S 5/2002 Hohlbein
D457,325 S 5/2002 Wilson et al.
6,383,202 B1 5/2002 Rosenblood
D458,453 S 6/2002 Baertschi
D459,086 S 6/2002 Belton et al.
D459,087 S 6/2002 Pfleger
6,402,768 B1 6/2002 Liebel
6,408,476 B1 6/2002 Cann
6,421,867 B1 7/2002 Welhrauch
D461,313 S 8/2002 Hohlbein
D461,959 S 8/2002 Chan et al.
6,440,149 B1 8/2002 Potti
D462,178 S 9/2002 Moskovich et al.
D462,528 S 9/2002 Crossman et al.
D463,131 S 9/2002 Winter et al.
D463,132 S 9/2002 Winter et al.
D463,133 S 9/2002 Hohlbein
6,446,295 B1 9/2002 Calabrese
D463,668 S 10/2002 Yoshimoto et al.
D464,796 S 10/2002 Winter et al.
6,463,619 B2 10/2002 Gavney, Jr.
D465,847 S 11/2002 Jacobs
D466,302 S 12/2002 Ping
6,494,594 B1 12/2002 Schroetter
6,496,999 B1 12/2002 Gleason et al.
6,513,182 B1 2/2003 Calabrese et al.
D471,276 S 3/2003 Potti
D471,362 S 3/2003 Moskovich et al.
6,546,586 B2 4/2003 Cho
6,553,604 B1 4/2003 Braun et al.
D474,608 S 5/2003 Hohlbein
6,564,416 B1 5/2003 Claire et al.
D475,531 S 6/2003 Kimeck et al.
D476,158 S 6/2003 Ling
6,571,417 B1 6/2003 Gavney, Jr.
D477,465 S 7/2003 Reilly et al.
6,599,048 B2 7/2003 Kuo
D478,211 S 8/2003 Ping
D478,213 S 8/2003 Ping
D478,424 S 8/2003 Saindon et al.
D478,425 S 8/2003 Ping
D478,727 S 8/2003 Wong
D479,046 S 9/2003 Winkler
D479,047 S 9/2003 Wong
D479,914 S 9/2003 Choong
6,625,839 B2 9/2003 Fischer
D480,213 S 10/2003 Ping
D482,199 S 11/2003 De Salvo
6,647,581 B1 11/2003 Persad et al.
D483,183 S 12/2003 De Salvo
D483,184 S 12/2003 Geiberger et al.
D483,568 S 12/2003 Jamson
6,654,979 B2 12/2003 Calabrese
D486,649 S 2/2004 Sprosta et al.
6,687,940 B1 2/2004 Gross et al.
D487,195 S 3/2004 Winkler
6,729,789 B2 5/2004 Gordon
6,735,804 B2 5/2004 Carlucci et al.
6,792,642 B2 9/2004 Wagstaff
6,817,054 B2 11/2004 Moskovich et al.
6,820,299 B2 11/2004 Gavney, Jr.
6,859,969 B2 3/2005 Gavney, Jr. et al.
6,865,767 B1 3/2005 Gavney, Jr.
D503,538 S 4/2005 Desalvo
6,886,207 B1 5/2005 Solanki
6,895,629 B1 5/2005 Wenzler
2001/0001334 A1 5/2001 Gruber et al.
2001/0023516 A1 9/2001 Driesen et al.
2001/0041903 A1 11/2001 Richard
2001/0042280 A1 11/2001 Moskovich et al.
2002/0004964 A1 1/2002 Luchino et al.
2002/0019645 A1 2/2002 Fischer et al.
2002/0100134 A1 8/2002 Dunn et al.
2002/0108194 A1 8/2002 Carlucci et al.
2002/0124333 A1 9/2002 Hafliger et al.
2002/0124337 A1 9/2002 Calabrese et al.
2002/0138926 A1 10/2002 Brown, Jr. et al.
2002/0138928 A1 10/2002 Calabrese
2002/0138931 A1 10/2002 Davies
2003/0009837 A1 1/2003 Cann
2003/0066145 A1 4/2003 Prineppi
2003/0077107 A1 4/2003 Kuo
2003/0084525 A1 5/2003 Blaustein et al.
2003/0115699 A1 6/2003 Wagstaff

| | | | |
|---|---|---|---|
| 2003/0116884 | A1 | 6/2003 | Wagstaff |
| 2003/0163149 | A1 | 8/2003 | Heisinger, Jr. |
| 2003/0167582 | A1 | 9/2003 | Fischer et al. |
| 2003/0196283 | A1 | 10/2003 | Eliav et al. |
| 2003/0208865 | A1 | 11/2003 | Davies |
| 2003/0216762 | A1 | 11/2003 | Levit |
| 2003/0229959 | A1 | 12/2003 | Gavney, Jr. et al. |
| 2004/0006837 | A1 | 1/2004 | Cann |
| 2004/0025275 | A1 | 2/2004 | Moskovich et al. |
| 2004/0031115 | A1 | 2/2004 | Gavney, Jr. |
| 2004/0068810 | A1 | 4/2004 | Lee |
| 2004/0134007 | A1 | 7/2004 | Davies |
| 2004/0177462 | A1 | 9/2004 | Brown, Jr. et al. |
| 2004/0200748 | A1 | 10/2004 | Klassen et al. |
| 2004/0221409 | A1 | 11/2004 | Gavney, Jr. |
| 2004/0231076 | A1 | 11/2004 | Gavney, Jr. |
| 2004/0237236 | A1 | 12/2004 | Gavney, Jr. |
| 2004/0255416 | A1 | 12/2004 | Hohlbein |
| 2005/0000049 | A1 | 1/2005 | Hohlbein |
| 2005/0015904 | A1 | 1/2005 | Gavney, Jr. |
| 2005/0038461 | A1 | 2/2005 | Phillips |
| 2005/0069372 | A1 | 3/2005 | Hohlbein et al. |
| 2006/0064833 | A1 | 3/2006 | Jacobs |

FOREIGN PATENT DOCUMENTS

| | | | |
|---|---|---|---|
| CH | 99738 | | 6/1923 |
| CH | 460705 | | 8/1968 |
| CN | ZL 99225704.2 | | 11/1999 |
| DE | 857128 | | 11/1952 |
| DE | 1657299 | A | 2/1971 |
| DE | 2930459 | | 2/1981 |
| DE | 3114507 | A1 | 3/1983 |
| DE | 3639424 | A1 | 6/1988 |
| DE | 3840136 | | 5/1990 |
| DE | 94 16 395 | U1 | 12/1994 |
| DE | 4412301 | A1 | 10/1995 |
| DE | 29821121 | U | 3/1999 |
| DE | 201 07 614 | U1 | 9/2002 |
| DE | 101 22 987 | A1 | 11/2002 |
| DE | 20 2005 009 026 | U1 | 10/2005 |
| EP | 0336641 | | 10/1989 |
| EP | 0 360 766 | | 3/1990 |
| EP | 0371293 | | 6/1990 |
| EP | 0454625 | | 10/1991 |
| EP | 0460610 | A | 12/1991 |
| EP | 0648448 | | 4/1995 |
| EP | 0875169 | A | 4/1998 |
| EP | 1 034 721 | A1 | 9/2000 |
| EP | 1059049 | A | 12/2000 |
| EP | 1 308 108 | B1 | 2/2006 |
| FR | 442832 | | 9/1912 |
| FR | 537979 | | 6/1922 |
| FR | 567187 | | 6/1923 |
| FR | 707727 | | 4/1931 |
| FR | 777340 | | 11/1934 |
| FR | 1100290 | | 3/1955 |
| FR | 1247433 | | 10/1960 |
| FR | 2594307 | A1 | 4/1987 |
| FR | 2652245 | | 3/1991 |
| GB | 17643 | | 4/1912 |
| GB | 189335 | | 11/1922 |
| GB | 304459 | | 1/1929 |
| GB | 412414 | | 6/1934 |
| GB | 495982 | | 11/1938 |
| GB | 647924 | | 12/1950 |
| GB | 2391462 | | 2/2004 |
| GB | 2 371 217 | B | 4/2004 |
| JP | 59-2224 | | 1/1984 |
| JP | 66-2303 | | 6/1985 |
| JP | 60-29527 | | 12/1994 |
| JP | 2000-000118 | A | 1/2000 |
| JP | 2000-278899 | | 10/2000 |
| JP | 2000/308522 | | 11/2000 |
| JP | 2000-308522 | | 11/2000 |
| JP | 2001/314232 | | 11/2001 |
| JP | 2001-314232 | A | 11/2001 |
| JP | 2002-142867 | | 5/2002 |
| JP | 2002-191436 | A | 7/2002 |
| JP | 2002223853 | A | 8/2002 |
| MX | 02 006372 | | 11/2002 |
| NL | 45 152 | C | 9/1938 |
| RU | 1708283 | | 1/1992 |
| WO | WO 92/17092 | | 10/1992 |
| WO | WO 92/17093 | | 10/1992 |
| WO | WO 94/05183 | | 3/1994 |
| WO | WO 94/09678 | | 5/1994 |
| WO | WO 96/02165 | | 2/1996 |
| WO | WO 96/15696 | | 5/1996 |
| WO | WO 97/25900 | | 7/1997 |
| WO | WO 97/95899 | | 7/1997 |
| WO | 98/05241 | | 2/1998 |
| WO | WO 98/07349 | | 2/1998 |
| WO | WO 98/08458 | | 3/1998 |
| WO | WO 98/09573 | | 3/1998 |
| WO | WO 98/18364 | A | 5/1998 |
| WO | WO 98/25500 | A1 | 6/1998 |
| WO | WO 99/37181 | | 7/1999 |
| WO | WO 99/37182 | | 7/1999 |
| WO | WO 99/49754 | A1 | 10/1999 |
| WO | WO 00/49911 | | 8/2000 |
| WO | 00/53054 | | 9/2000 |
| WO | WO 00/64307 | | 11/2000 |
| WO | WO 00/76369 | | 12/2000 |
| WO | WO 01/17433 | A1 | 3/2001 |
| WO | WO 2001/17433 | A1 | 3/2001 |
| WO | WO 01/45573 | A1 | 6/2001 |
| WO | WO 01/80686 | A2 | 11/2001 |
| WO | WO 01/91603 | | 12/2001 |
| WO | WO 02/062174 | | 8/2002 |
| WO | WO 02/071967 | A2 | 9/2002 |
| WO | WO 02/087464 | A1 | 11/2002 |
| WO | WO 03/020159 | A1 | 3/2003 |
| WO | WO 03/030680 | A | 4/2003 |
| WO | 2004/019801 | A2 | 3/2004 |
| WO | WO 2004/026162 | A2 | 4/2004 |
| WO | WO 2004/028235 | A2 | 4/2004 |
| WO | WO 2004/082428 | | 9/2004 |

OTHER PUBLICATIONS

"Guide for Injection Molding," Pro-fax polypropylene, Himont U.S. A. Inc., Nov. 1989.

"Construeren in Kunststoffen Deel B," T. Delft, 1986.

ORAL CARE IMPLEMENT

CROSS-REFERENCE TO RELATED APPLICATIONS

The present application is a continuation in part of U.S. patent application Ser. No. 10/869,922 filed Jun. 18, 2004 (now U.S. Pat. No. 7,143,462), which is a continuation in part of U.S. patent application Ser. No. 10/601,106, filed Jun. 20, 2003 (now abandoned), a continuation in part of co-pending PCT Patent Application Serial No. PCT/US03/030633 (designating the U.S.) filed Sep. 26, 2003, which claims the benefit of U.S. Provisional Application No. 60/414,117, filed Sep. 27, 2002, U.S. Provisional Application No. 60/418,776, filed Oct. 16, 2002, and U.S. Provisional Application No. 60/419,425, filed Oct. 18, 2002, a continuation in part of PCT Application No. PCT/US03/029497 (designating the U.S.), filed Sep. 17, 2003, which claims the benefit of U.S. Provisional Application No. 60/412,290, filed Sep. 20, 2002, and a continuation in part of U.S. patent application Ser. No. 29/189,729, filed Sep. 10, 2003 (now U.S. Pat. No. D517,812). The present application is also a continuation-in-part of U.S. patent application Ser. No. 10/109,637 (now U.S. Pat. No. 6,996,870), filed Apr. 1, 2002, which is a continuation-in-part of U.S. patent application Ser. No. 29/148,074, filed Sep. 14, 2001 (now U.S. Pat. No. D456,139), and is a continuation in part of U.S. patent application Ser. No. 09/897,606, filed Jul. 3, 2001 (now U.S. Pat. No. 6,442,787). The contents of the above-noted applications are each expressly incorporated herein by reference.

FIELD OF THE INVENTION

The present invention pertains to an oral care implement with a cleanser for cleaning soft tissue surfaces in the mouth.

BACKGROUND OF THE INVENTION

According to the American Dental Association, a major source of bad breath in healthy people is microbial deposits on the tongue, where a bacterial coating harbors organisms and debris that contribute to bad breath. The tongue is a haven for the growth of microorganisms since the papillary nature of the tongue surface creates a unique ecological site that provides an extremely large surface area, favoring the accumulation of oral bacteria. Anaerobic flora and bacteria residing on the tongue play an important role in the development of chronic bad breath commonly called halitosis. In general, the bacteria produce volatile sulfur compounds (VSC). If there is enough buildup of the sulfur compounds, the result can be lead bad breath or oral malodor.

Bladed tongue scrapers have been used in the past, but have generally been inadequate in respect to their effectiveness and/or safety. Moreover, notwithstanding the benefits to be gained by any ability to clean the tongue, some users avoid the use of such blades because of lack of comfort on the tongue surface.

Hence, there is a need for an oral care implement with a tongue cleanser that provides effective removal of the tongue bacteria and other debris while maintaining comfort to the user.

BRIEF SUMMARY OF THE INVENTION

The invention pertains to an oral care implement with a tissue cleanser that provides improved cleaning and effective removal of bacteria and microdebris disposed on the oral tissue surfaces.

In one aspect of the invention, the tissue cleanser includes a plurality of nubs for cleaning soft tissue surfaces in the mouth and particularly for cleaning between the papillae of the tongue. In a further preferred aspect of the invention, the tissue cleanser includes a plurality of conically shaped nubs.

In another aspect of the invention, the tissue cleanser is constructed from an elastomeric material. In one preferred embodiment, the tissue cleanser is formed as an elastomeric pad mounted on the head of the oral care implement for improved cleaning, ease of manufacture, and user comfort.

In another aspect of the invention, the tissue cleanser includes at least one projection that protrudes from a base of material extending along the head of the implement. In one embodiment, a plurality of projections extend along the head in a spaced apart relationship along a pad formed as an elongate strip that is fixed to the head. In one construction, the base overlies a generally rigid head structure. Alternatively, the base is integrally formed as part of the head thereby forming a flexible head.

In another aspect of the invention, the soft tissue cleanser includes a combination of at least one elongate ridge and a plurality of nubs or other discrete projections having a non-elongate structure. As a result, the tongue and other soft tissue of the mouth are cleaned with the benefit of both kinds of cleanser projections for an enhanced cleaning effect.

In another aspect of the invention, the soft tissue cleanser includes a combination of hard and soft projections to clean the tongue and other soft tissue in the mouth. In one construction, the cleanser includes a plurality of soft nubs and at least one elongate ridge of hard material. In this way, the combined benefits of a soft and hard cleanser can be gained in one implement.

In another aspect of the invention, the soft tissue cleanser includes at least one projection with a scraping edge to be moved over the tongue or other tissue. The edge is formed by sloped surfaces having different inclinations. In one construction, a steeper slope faces generally toward the handle to provide a more aggressive scraping action as the head is dragged out of the mouth. The shallower surface makes the projection less prone to pushing tongue biofilm farther back in the throat.

In another aspect of the invention, the oral care implement includes a seat to facilitate and ease molding of the tissue cleanser to the head. In one preferred construction, the head has one or more protuberances for anchoring the head during molding of the tissue cleanser. The head may also include a basin to further define the outline of the molded tissue cleanser.

In another aspect of the invention, an oral care implement includes a tissue cleanser having means for reducing oral volatile sulfur compounds by 35% from a baseline measured two hours after use.

In another aspect of the invention, an oral care implement is provided with tooth cleaning elements and a tissue cleanser for a thorough cleaning of the teeth, gums, tongue and oral surfaces of the cheeks and lips. In a preferred construction, the tooth cleaning elements and tissue cleanser are supported on opposite sides of a supporting head.

In one other aspect of the invention, an oral care implement which includes tooth cleaning elements and a tissue cleanser forms at least one of the tooth cleaning elements as a unitary member with the tissue cleanser.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description, the invention is discussed in terms of a toothbrush. For example, toothbrush 100 is shown as one embodiment in FIG. 1, and toothbrush 500 as an alternative embodiment in FIG. 8. Nevertheless, the invention could be used in other oral care implements including simply a tissue cleansing implement.

Further, it is to be understood that other embodiments may be utilized and structural and functional modifications may be made without departing from the scope of the present invention.

Figure 1:
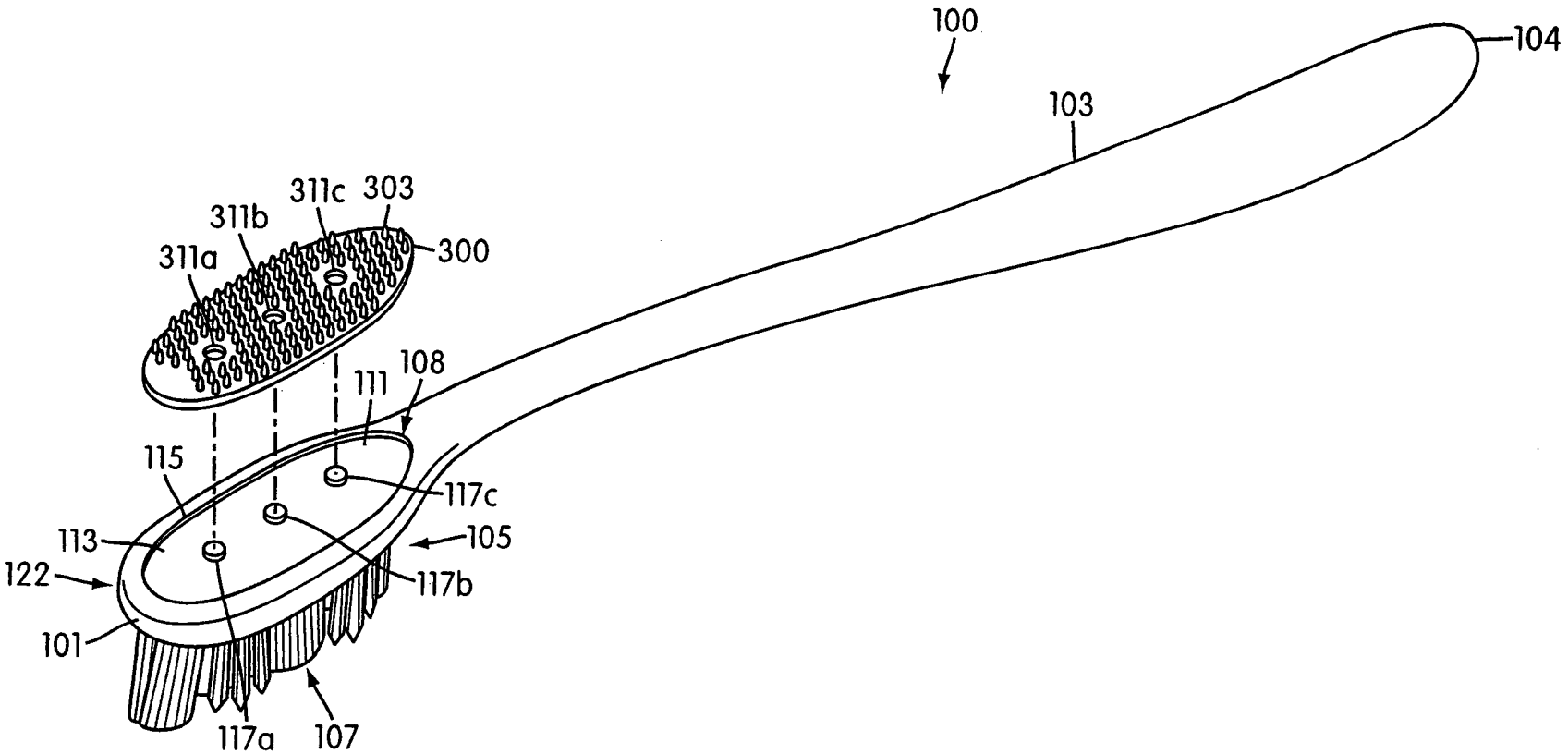
FIG. 1 is an exploded assembly perspective view of an oral care implement according to one or more aspects of an illustrative embodiment.
Figure 2:
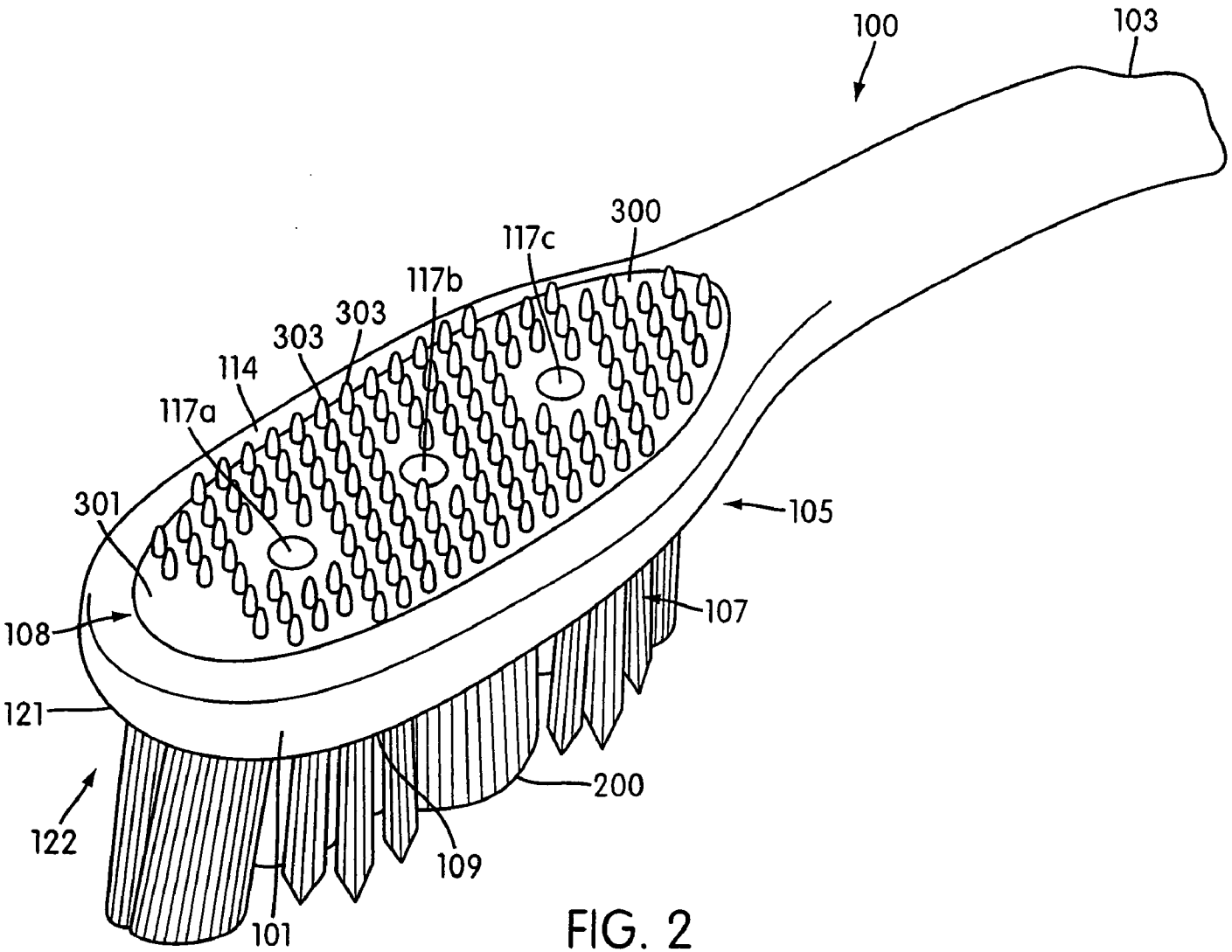
FIG. 2 is an enlarged perspective view of a head of an oral care implement of FIG. 1.
Figure 3:
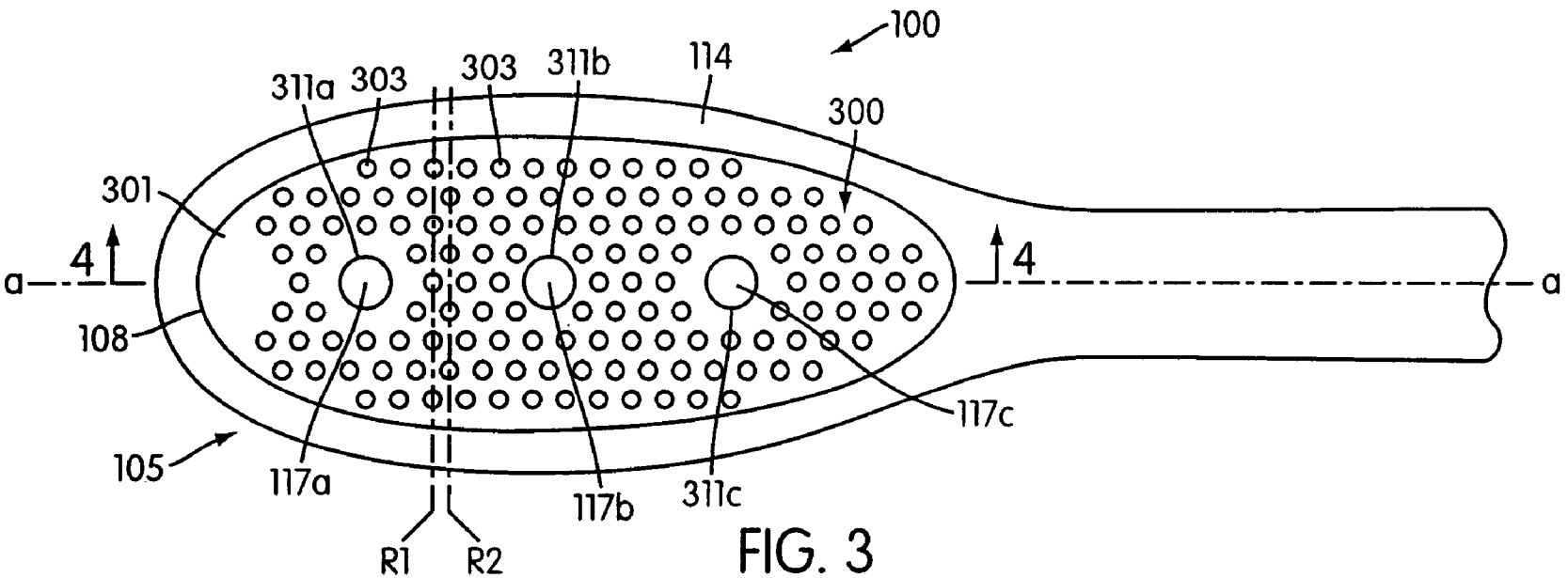
FIG. 3 is a plan view of the oral care implement of FIG. 1 illustrating a tongue cleaning feature.

As seen in FIGS. 1-7, an oral care implement in the form of a toothbrush 100 includes a handle 103 and a head 105 which may be used for cleaning the teeth and soft tissue in the mouth, such as the tongue, interior surfaces of the cheeks, lips or the gums. Handle 103 is provided for the user to readily grip and manipulate the toothbrush, and may be formed of many different shapes and constructions. While the head is normally widened relative to the neck of the handle, it could in some constructions simply be a continuous extension or narrowing of the handle. In the preferred construction, head 105 has a first face 106 that supports tooth cleaning elements 107 (FIGS. 5 and 6) and a second face 108 that supports a tissue cleanser 300 (FIGS. 2 and 3). The first and second faces 106, 108 are preferably on opposite sides of head 105. Nevertheless, tissue cleanser 300 may be mounted elsewhere, such as the proximal end 104 of handle 103. The tissue cleanser 300 or portions of it may also be located on the peripheral sidewall surface 101 of head 105 or extend farther towards the proximate end 104 of handle 103 than illustrated.

The elastomeric material of tissue cleanser 300 may be any biocompatible resilient material suitable for uses in an oral hygiene apparatus. To provide optimum comfort as well as cleaning benefits, the elastomeric material preferably has a hardness property in the range of A8 to A35 Shore hardness. As an example, one preferred elastomeric material is styrene-ethylene/butylene-styrene block copolymer (SEBS) manufactured by GLS Corporation. Nevertheless, SEBS material from other manufacturers or other materials within and outside the noted hardness range could be used.

Tissue cleanser 300 is preferably configured with a multiplicity of tissue engaging elements 303 (FIGS. 1-4), which in the preferred construction are formed as nubs.

Alternative nub constructions 502, as discussed below, are also illustrated in alternative constructions in FIGS. 8-12. As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

Such tissue engaging elements 303 are designed to significantly reduce a major source of bad breath in people and improve hygiene. Nubs 303 enable removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise pulled against a tongue surface, for example, nubs 303 of elastomeric tissue cleanser 300 provide for gentle engagement with the soft tissue while reaching downward into the recesses of adjacent papillae of the tongue. The elastomeric construction of tissue cleanser 300 also enables the base surface 301 to follow the natural contours of the oral tissue surfaces, such as the tongue, cheeks, lips, and gums of a user. Moreover, the soft nubs 303 are able to flex as needed to traverse and clean the soft tissue surfaces in the mouth along which it is moved.

Figure 4:
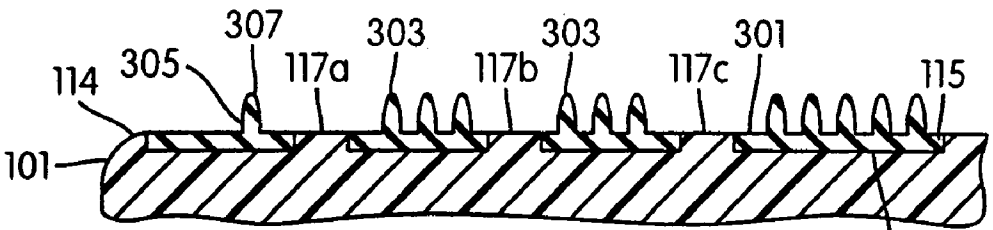
FIG. 4 is a partial section view of a head of the oral care implement of FIG. 1 taken along line 4-4 of FIG. 3.

As seen in FIG. 2 and 4, in one preferred arrangement of tissue cleanser 300, nubs 303 are preferably conically shaped. As used herein, "conically shaped" or "conical" is meant to include true cones, frusto-conically shaped elements, and other shapes that taper to a narrow end and thereby resemble a cone irrespective of whether they are uniform, continuous in their taper, or have rounded cross-sections. With reference to FIG. 4, the base portion 305 of each conically shaped tissue engaging element 303 is larger than the corresponding tip portion 307. In this conically shaped configuration, the base portion 305 has a wider cross-sectional area to provide effective shear strength to withstand the lateral movement of the tissue cleanser 300 along the surface of the tongue or other soft tissue surface. The smaller width or diameter of the tip portion 307 in conjunction with the length of the conically shaped nub 303 enable the nubs to sweep into the recesses of the tongue and other surfaces to clean the microbial deposits and other debris from the soft tissue surfaces. In the preferred construction, nubs 303 are able to flex and bend from their respective vertical axes as lateral pressure is applied during use. This flexing enhances the comfort and cleaning of the soft tissue surfaces. In a preferred construction, the thickness or width of the base of the nub in 0.64 mm, and preferably within the range from about 0.51 mm to about 2.00 mm. Tip 307 of the nubs is 0.127 mm and preferably within a that range from about 0.10 mm to about 0.75 mm for optimal penetration between the recesses of papillae of a user's tongue. The length or height of nubs 303, as measured from base surface 301 to tip 307, is preferably 0.91 mm and preferably within range from about 0.5 mm to about 2.5 mm, and most preferably range between 0.75 mm to 1.5 mm. Nevertheless, nubs of other sizes and shapes outside the given ranges can be used.

Alternatively, the tissue cleaning elements 303 may have other shapes. As one example, the tissue cleanser may have a grated form such as described in co-pending U.S. patent application Ser. No. 10/601,106, incorporated herein by reference.

In a preferred construction, nubs 303 are disposed on the base surface 301 of tissue cleanser 300 in a high density pattern. Each nub 303 is preferably spaced apart from adjacent nubs 303 between a range of about 0.5 mm to about 3 mm; more preferably the spacing ranges between 0.7 mm to 2.5 mm, and most preferably between 1 mm to 2 mm. Nevertheless, other spacing ranges are possible. The surface density of the nubs 303 on base surface 301 ranges preferably from about 100 to about 600 nubs per square inch. In a more preferred construction of the tissue cleanser, the surface density may range from 200 to 500 nubs per square inch, and most preferably between 300 to 450 nubs per square inch. In one preferred example, tissue cleanser 300 includes about 400 nubs per square inch of surface area. The surface density features in conjunction with the height of the nubs 303 enables the tissue cleanser to provide enhanced cleaning of the soft tissue surfaces with improved comfort. Nonetheless, other surface densities are possible.

As seen in FIG. 3, nubs 303 are preferably disposed in longitudinal rows in a direction generally parallel to the longitudinal axis a-a. Further, nubs 303 are disposed in transverse rows R1, R2 on an axis parallel to base surface 301 and generally perpendicular to the longitudinal axis a-a. In one preferred construction, adjacent nubs 303 are provided on the base surface 301 in a staggered arrangement.

For example, adjacent transverse rows of nubs R1 and R2 have nubs 303 that are not directly behind each other. A fist nub is said herein to be "directly behind" second nub when it is located within the lateral bounds of the second nub extending in a longitudinal direction. This configuration enables improved cleaning of the soft tissue surfaces by facilitating the removal of microflora and other debris, and especially from the recesses of adjacent papillae of the tongue. Nonetheless, the nubs could be arranged randomly or in a myriad of different patterns.

Tongue cleanser 300 is preferably formed by being molded to head 105, although other manufacturing processes could be used. With reference to FIGS. 1 and 4, tissue cleanser 300 is preferably molded within a basin or a receiving cavity 111 in face 108 of head 105. The receiving cavity 111 has a lower base surface 113 and a peripheral sidewall 115 extending away from the lower base surface 113. In one mounting arrangement, nubs 303 of the tissue cleanser 300 are exposed for use with the base surface of the tissue cleanser 300 being flush or recessed relative to the surface 114 of the head. Nevertheless, other orientations are possible. Also, base surface 301 of the tissue cleanser could be embedded in head 105 or covered by another layer with nubs 303 projecting through appropriate openings.

As can be seen in FIGS. 1 and 4, face 108 also preferably includes one or more peg members 117*a-c* disposed within basin 111. Peg members 117 form anchor points against the opposing mold to prevent the head from moving under the pressure of the injection molding. As a result, tissue cleanser 300 preferably includes one or more complementary apertures 311*a-c* which exposes the tops of peg members 117*a-c*. Although, the pegs are illustrated in alignment along the centerline of the head (e.g. longitudinal axis a-a), the pegs could have many different positions. Further, the pegs and basin are preferably both included with head 105, but either could be used without the other.

Alternatively, basin 111 and peg members 117*a-c* may be provided to position and hold a previously molded tissue cleanser, although these constructions are not necessary to use such a previously molded tissue cleanser.

Peg members 117*a-c* may take on a variety of shapes and lengths. With continued reference to the FIGS. 1 and 4, head 105 includes peg members 117*a-c* extending away from the lower base surface 113 of basin 111 to the height of the peripheral sidewall 115. The peg members 117*a-c* are shaped in the form of a cylinder, but other shapes and lengths of the peg members 117*a-c* are possible. While the molding process would preferably bond the tissue cleanser to the head, the tissue cleanser could be performed and attached by adhesive or other known means.

Figure 14:
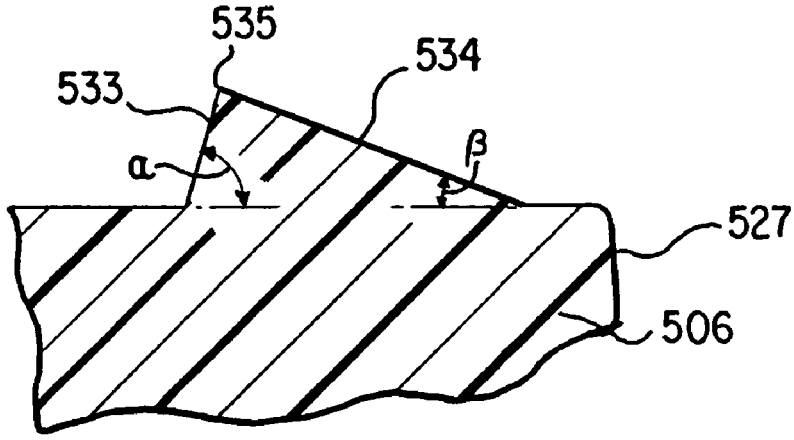
FIG. 14 is a partial cross-sectional view taken along line XIV-XIV in FIG. 13.

As shown in FIGS. 14, tissue cleanser 300 is preferably formed as a pad composed of a soft and pliable elastomeric material for comfortable cleaning and effective removal of bacteria and debris disposed on the surface of the tongue, other soft tissue in the mouth and even along the lips. The tissue cleanser 300 also provides effective massaging, stimulation and removal of bacteria, debris and epithelial cells from the surfaces of the tongue, cheeks, gums or lips.

In the preferred construction (FIGS. 1-6), tissue cleansers 300 may rub against the inside surfaces of the cheeks or lips, and on the sides of the tongue while the user brushes his or her teeth, and thus provide a desired massaging, stimulation and cleaning of various soft tissue surfaces within the mouth. For example, during brushing of the facial tooth surfaces, tissue cleanser 300 is disposed on the outer face 108 of head 105 to naturally rub against the oral surfaces of the cheek. As a result, enhanced cleaning is attained without additional cleaning steps. Further, some users may sense a stimulating tingle on the cheek surfaces that leads to a positive user reaction, and even enjoyment of the comfortable feel of the tissue cleanser along the soft tissues surfaces in the mouth. Tissue cleanser 300 may also be additionally rubbed on the cheeks, tongue, etc. as desired for further cleaning aside from the contact that may occur while brushing the teeth.

Figure 5:
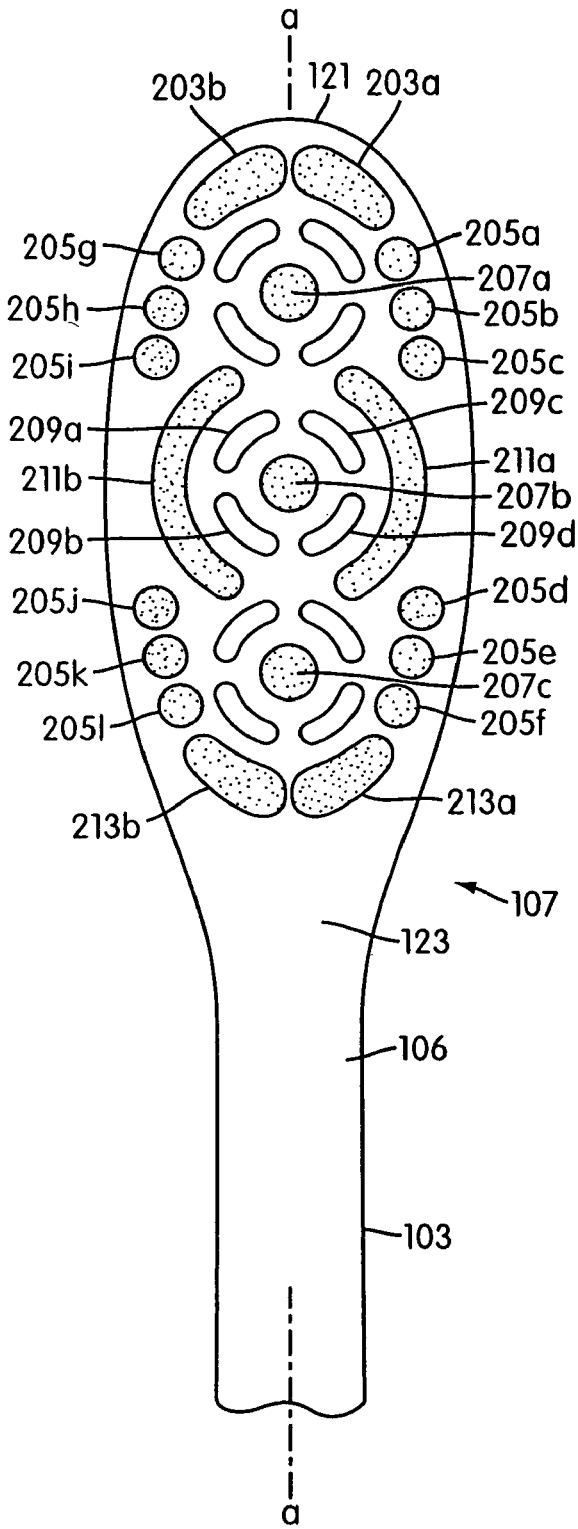
FIG. 5 is a plan view of the oral care implement of FIG. 1 illustrating at least one tooth cleaning configuration.
Figure 6:
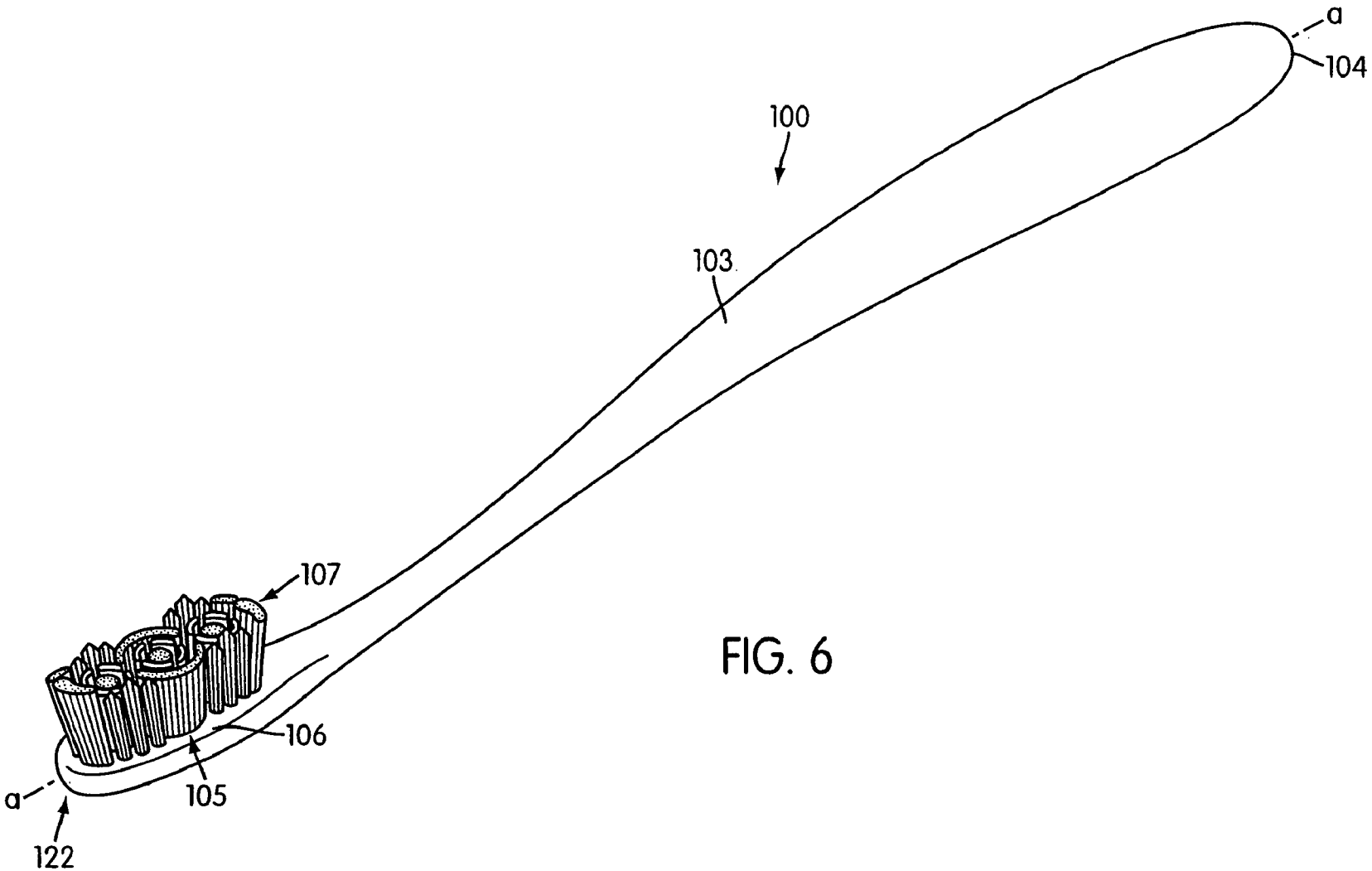
FIG. 6 is a perspective of the view of the oral care implement illustrating example tooth cleaning elements.

Referring to FIGS. 5 and 6, the tooth cleaning elements 107 of head 105 may include a variety of tooth cleaning elements which can be used for wiping, cleaning and massaging the user's teeth and gums. Any suitable form of tooth cleaning elements may be used. The term "tooth cleaning elements" is used in a generic sense which refers to filament bristles or elastomeric fingers or walls that have any desirable shape. In the illustrated example of FIG. 5, tooth cleaning elements 107 include distal tooth cleaning elements 203*a-b* disposed at a distal tip 121 of head 105, peripheral tooth cleaning elements 205*a-l*, longitudinal tooth cleaning elements 207*a-c* disposed along longitudinal axis a-a, arcuate tooth cleaning elements 209*a-d* and 211*a-b*, and proximal cleaning elements 213*a,b*. Tooth cleaning elements 205, 207, 211 and 213 are preferably provided as tufts of bristles whereas tooth cleaning elements 209 are preferably formed as elastomeric walls. Nevertheless, other forms and types of tooth cleaning elements may be used.

Figure 7:
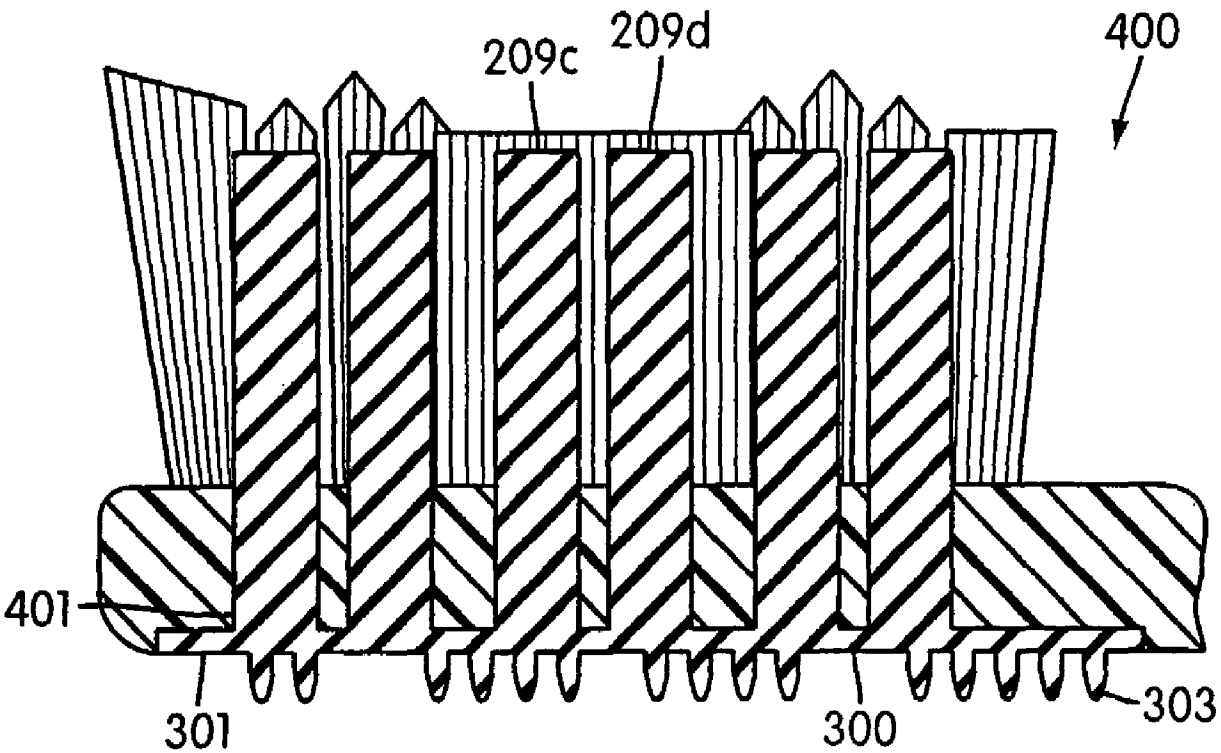
FIG. 7 is a section view of an alternative construction of the head of an oral care implement.

FIG. 7 illustrates a sectional view of an alternative arrangement of a head 400 of a toothbrush. Head 400 is similar in construction to head 105, except that tooth cleaning elements 209*a-d* are integrally formed with tissue cleanser 300. To accomplish the alternative construction, head 400 has appropriately sized ports or openings 401 to allow the elastomeric material to flow through the head during an injection molding process. In this construction, tooth cleaning elements 209*a-d* and tissue cleaner 300 are formed with the same elastomeric material. Thus, head 400 may include at least one elastomeric tooth cleaning element formed as a unitary member with tissue cleanser 300.

Figure 8:
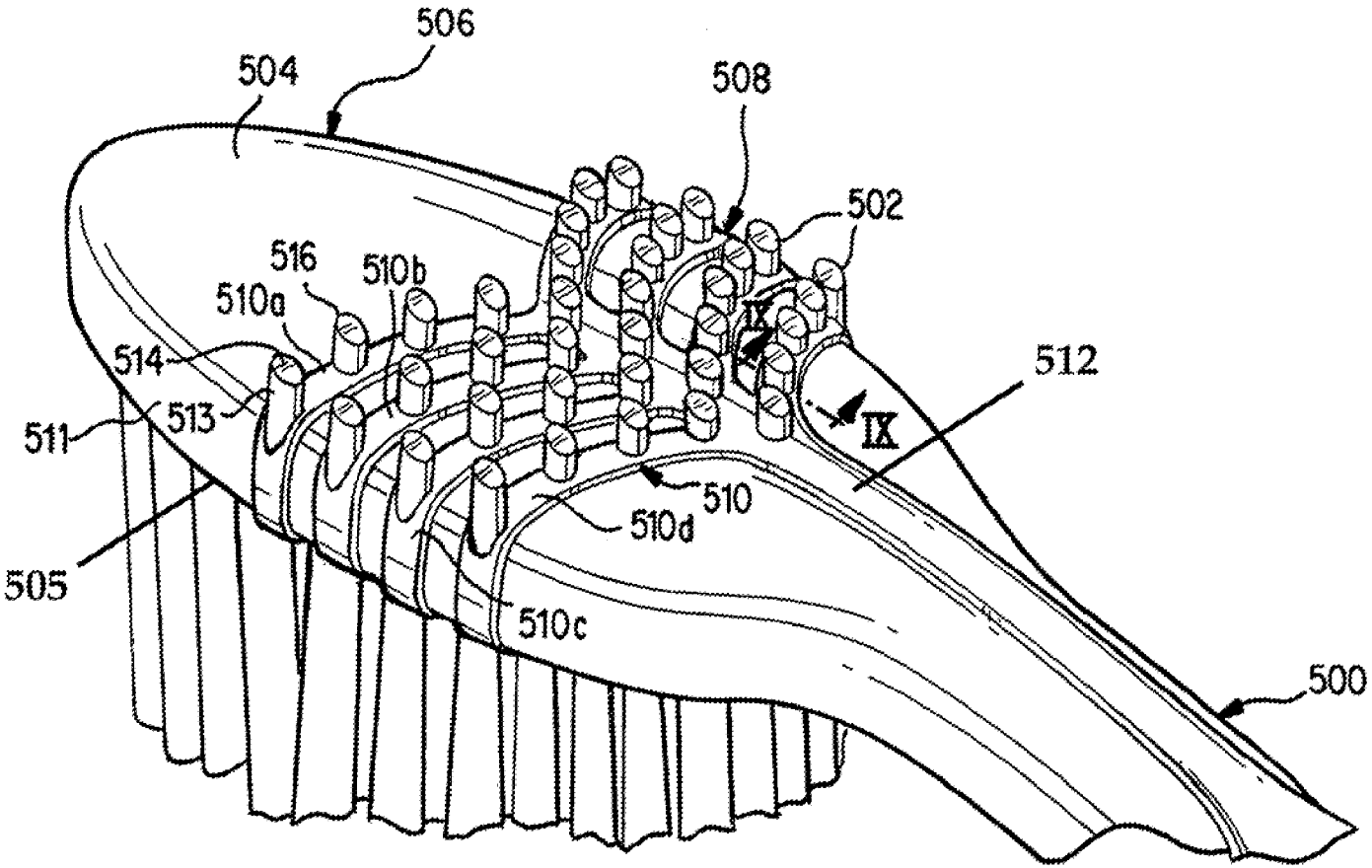
FIG. 8 is a perspective view of an alternative embodiment of the invention.

In FIG. 8, toothbrush 500 includes a plurality of nubs or other projections 502 protruding from a back side 504 of head 506 as a cleanser 508 of soft tissue in the mouth. Teeth cleaning elements preferably extend from a front side 505 of head 506. The projections 502 are preferably arranged seriatim along at least one narrow base or pad in the form of a strip 510 fixed to the head 506. In the illustrated example, a plurality of generally parallel strips 510*a*, 510*b*, 510*e*, 510*d* are fixed in a generally concave shape facing away from the handle. In this one construction, the strips extend along back side 504 of head 506 and each sidewall 511, although extensions along the sidewalls are not necessary. Any number of strips could be included. The strips could define virtually any shape or orientation on the head. For example, strips 510 could have any of the shapes disclosed for the ridges in co-pending U.S. patent application Ser. No. 10/989,267, filed Nov. 17, 2004, entitled "Oral Care Implement", which is incorporated herein by reference. In the illustrated construction, strips 510 are interconnected by an axial stem 512 which extends into the handle and forms a part of the grip for the user. Further, this handle extension or even the stem is of course not necessary.

Figure 9:
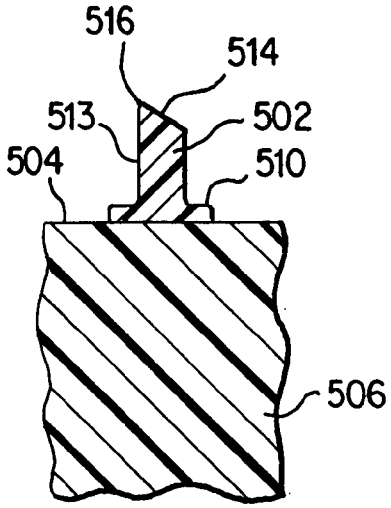
FIG. 9 is a partial cross-sectional view taken along line IX-IX in FIG. 8.
Figure 10:
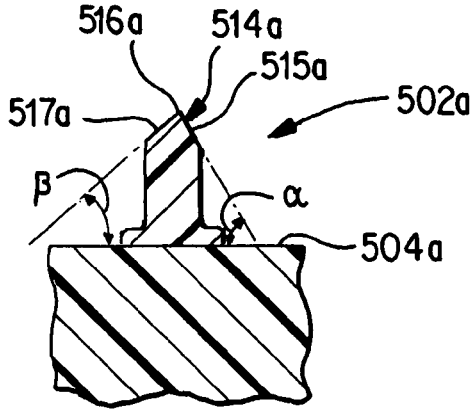
FIG. 10 is a partial cross-sectional view of an alternative embodiment of the invention taken along line IX-IX in FIG. 8.

In one construction, each projection 502 is generally columnar and formed with a width W of about 1.1 mm and a height H of about 1.7 mm (FIG. 9). The projections are spaced apart from each other along strip 510 a distance of about 1.0 mm. These height, width and spacing dimensions could, however, vary widely. In the illustrated embodiment, projections 502 each includes a peripheral wall 513 protruding outward from base 510, and an inclined distal end surface 514 at an angle of about 50 degrees to side surface 504 of head 506. The inclined end surface 514 defines a narrow top edge 516 along a portion of peripheral wall 513, which is advantageous for cleansing the tongue and other soft tissue. Although the end surfaces 514 are shown to be inclined in the same direction, they could be inclined in different directions.

In an alternative construction (FIG. 13), head 506 is additionally formed with at least one elongate ridge 525. With this arrangement, the user is provided with a cleanser that obtains a beneficial dual cleaning effect by moving the discrete projections 502 and the ridge 525 across the tongue or other tissue. In the illustrated example, ridge 525 is a curved, elongate projection protruding generally outward along the outer edge of the remote end 527 of the head. Nevertheless, other arrangements, locations and shapes are possible. Additional ridges could also be provided. In one preferred construction, ridge 525 is molded as one-piece with the head and formed of a relatively hard plastic such as polypropylene. The ridge, however, could be formed separately from the head and/or composed of other materials that are compatible for oral care implements.

In one construction, ridge 525 is, as noted above, formed of a relatively hard material (e.g., polypropylene), while projections 502 are formed of a relatively soft material (e.g., a thermoplastic elastomer). This use of dual materials enables the benefits of both materials to be gained. The cleanser includes the firm engagement of the relatively hard scraper blade in ridge 525 and the relatively soft discrete projections that flex and turn as they dig into the tongue or other tissue.

Figure 13:
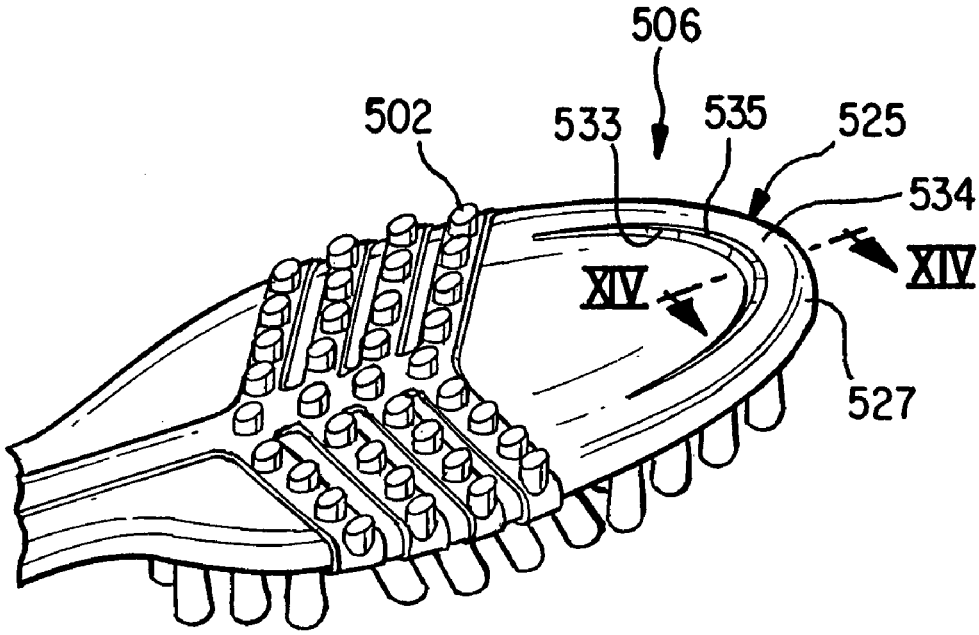
FIG. 13 is a partial perspective view of an alternative oral care implement in accordance with the present invention.

As seen in FIGS. 13 and 14, ridge 525 is defined by a pair of opposite sidewalls 533, 534 which meet to form a scraper edge 535. While edge 535 is relatively narrow in this construction, it could be substantially widened. In one embodiment, sidewalls 533, 534 are formed with different slopes relative to side 504 of head 506, though they could have the same slope. In one preferred construction, sidewall 533 is formed with a steeper slope than sidewall 534 to define a more aggressive scraping action as the head is pulled across the tongue by the user. The shallower slope of sidewall 534 facing generally away from the handle, makes the ridge less prone to pushing the tongue biofilm farther back in the throat as the ridge is pushed back toward the throat. In a preferred embodiment, sidewall 533 is oriented at an angle $\alpha$ of 62 degrees relative to side 504, whereas sidewall 534 is oriented at an angle $\beta$ of 43 degrees. Other angles could also be used for both sidewalls.

In another alternative construction (FIG. 10), each projection 502*a* is provided with an end surface 514*a* having two inclined end face portions 515*a*, 517*a* and a top edge 516*a*. As with ridge 525, end face portion 515*a*, generally facing toward the handle, is preferably inclined at a steeper angle relative to side 504*a* than end face portion 517*a*, although other arrangements including end face portion having the same inclination can be used. As one example, end face portion 515*a* is oriented at an angle $\alpha$ of 62 degrees relative to side 504*a*, and end face portion 517*a* is oriented at an angle $\beta$ of 43 degrees. The steeper angle of end face portion 515*a* provides a more aggressive scraping action as the head is dragged out of the mouth. The shallower angle of end surface 517*a* makes the projection less prone to pushing the tongue biofilm farther back in the throat.

Of course, other projections can be used. For example, each projection could include a non-inclined distal end or an end that tapers to a pointed tip. The projections could have a wide variety of shapes beyond the cylindrical shape shown in FIG. 8. For example, the projections could have a conical shape, irregular cross sections, or be inclined to the back side 504. Moreover, the projections may also be ridge shaped to extend entirely or partially along the length of strip 510.

In a preferred construction, projections 502 and strip 510 are formed as a one piece member molded or otherwise secured to head 506. The projections and strip are preferably formed as a one-piece member of a resilient thermoplastic elastomer such as styrene-ethylene/butylene-styrene block copolymer (SEBS) manufactured by GLS Corporation, but could be composed of other resilient materials, hard materials, or a combination of materials such as disclosed in U.S. patent application Ser. No. 11/011,605, filed Dec. 15, 2004, entitled Oral Care Implement, incorporated herein by reference. The projections and strips could also be formed of the same substance as head 506 (e.g., polypropylene) but have a different color or the like to define it a different material from the head and thereby create at least a visually appealing brush.

Figure 11:
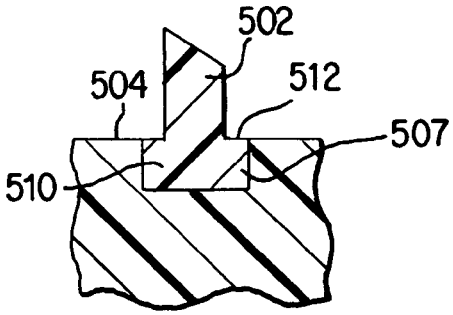
FIG. 11 is a partial cross-sectional view of another alternative embodiment taken along line IX-IX in FIG. 8.
Figure 12:
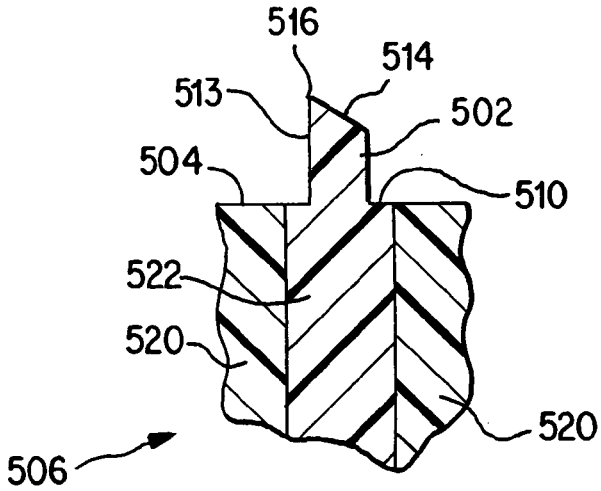
FIG. 12 is a partial cross-sectional view of another alternative embodiment taken along line IX-IX in FIG. 8.

In one construction, strips 510 are molded to overlie a generally planar surface 504 of head 506 (FIG. 9). Nevertheless, channels 507 could be formed in side 504 to receive strips 510 therein so that side 504 and the outer surfaces 512 of strips 510 having projections 502 are generally co-planar (FIG. 11). Additionally, the strips of resilient material could be formed as an integral part of the head construction (FIG. 12). More specifically, in this alternative construction, the head includes a plurality of first members 520 joined together by a resilient second member 522 that acts as a living hinge to permit the first members to move relative to each other during use of the toothbrush. The second member also forms the base 510 of soft tissue cleanser 508 provided with projections 502. Additionally, as discussed in regard to toothbrush 400, projections 502 or 502*a* can be integrally formed as a one-piece member with elastomeric tooth cleaning elements extending in an opposite directions from the head.

Figure 15:
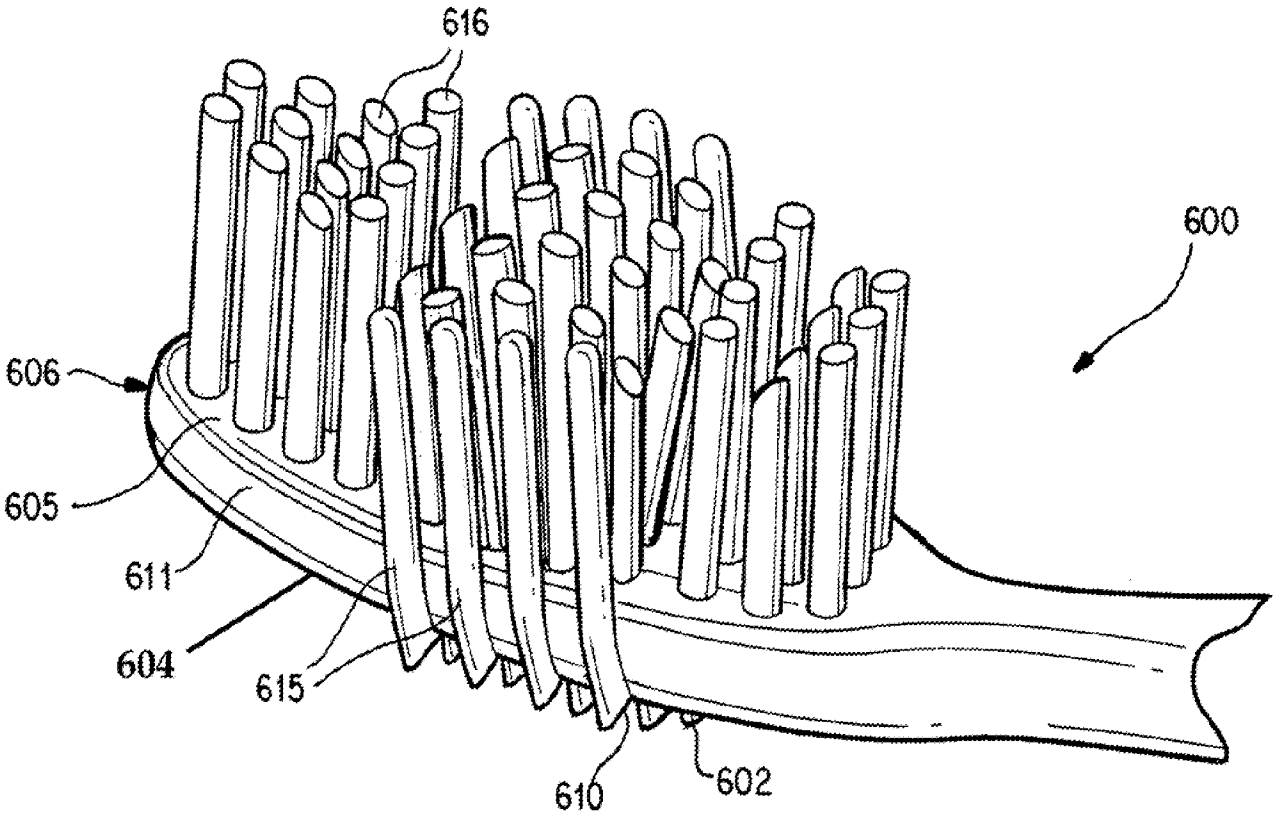
FIG. 15 is a partial perspective view of an alternative oral care implement in accordance with the present invention.

In another alternative construction (FIG. 15), a toothbrush 600 includes a soft tissue cleanser 602 of any of the alternatives discussed above or others using a resilient material. In this embodiment, a portion of cleanser 602 wraps around the sidewalls 611 of head 606 and includes resilient members 615 that project from the head to provide, for example, cleaning of the teeth and gums, and massaging of the gums when the toothbrush is applied along the gum line. In one example, cleanser 602 has a construction similar to the cleanser in FIG. 8 or 13. Bases 610 in the form of strips extend across the back side 604 of head 606 and over sidewalls 611. The bases are preferably formed of a soft, elastomeric material such as a thermoplastic elastomer (e.g., SEBS), but could be formed of other resilient materials. Resilient members 615 are preferably formed as one piece with the portions of the bases that overlie sidewalls 611. As shown in FIG. 15, resilient members 615 project from sidewalls 611 in the same general direction as teeth cleaning elements 616. Nevertheless, they could alternatively be inclined to extend laterally outward. In addition, although resilient members 615 are shown to be inclined toward the free end of head 606, they could extend at right angles to side 605, be inclined in other directions, or have non-uniform orientations.

As various changes could be made in the above methods, compositions and structures without departing from the scope of the invention, it is intended that all matter contained in this application, including all mechanisms and/or modes of interaction described above, shall be interpreted as illustrative only and not limiting in any way the scope of the appended claims.

The following examples are set forth as representative of the improved operation of the present invention. These examples are not to be construed as limiting the scope of the invention.

EXAMPLE 1

The performance nature of a toothbrush can be measured using known oral malodor assessment methods. A study was conducted to evaluate the performance of a toothbrush provided with an elastomeric tissue cleanser having conically shaped nubs, such as the preferred construction of toothbrush 100 discussed above. Human test subjects participated in the study. There was a washout or normalization period prior to testing of about 7 days in which the test subjects brushed twice a day with a fluoride dental cream (see Table 1). After the washout period, the test subjects were asked to refrain from any oral hygiene (brushing, rinsing, and flossing), eating and drinking prior to oral testing. A baseline volatile sulfur compound (VSC) sample was taken from each of the test subjects. In the study for overnight odor control, the test subjects brushed their teeth for one minute with a fluoride dental cream (see Table 1) using toothbrush 100 provided with the above noted tissue cleanser 300. Subsequently, the subjects cleaned their tongue surface with the tissue engaging elements of the toothbrush for ten seconds. The test subjects slept overnight and returned for post treatment. VSC samples were taken at the ten-hour time point from the previous day cleaning. In the illustrative example, use of the toothbrush reduced oral VSC about 60% verses brushing the teeth alone as measured from a baseline ten hours after use. The VSC readings were obtained by gas chromatography.

EXAMPLE 2

In another study of the above-noted toothbrush 100, there was a washout or normalization period prior to testing of about 7 days which the test subjects brushed twice a day with a fluoride dental cream (see Table 1). The test subjects were asked to refrain from any oral hygiene (brushing, rinsing, and flossing), eating and drinking before testing. After the washout period, the test subjects provided a baseline tongue bacteria sample by swabbing a side of the back of the tongue with a sterile cotton swab. The test subjects brushed their teeth with a fluoride dental cream (see Table 1) for one minute with the toothbrush having the above-noted tissue cleanser. Subsequently, the test subjects cleaned their tongue surface with a preferred construction of the tissue engaging elements 300 of the toothbrush 100 for ten seconds. Two hours after the cleaning of the tongue surface, a tongue bacteria sample was taken from a side of the back of the tongue with a cotton swab. In the illustrative example, use of the tissue engaging elements controlled more odor causing tongue bacteria than simply brushing the teeth alone. Use of the tissue cleanser 300 demonstrated a tongue bacteria log reduction of over 0.8 Log colony forming units/ml two hours after use on the tongue.

EXAMPLE 3

In another study of the above-noted toothbrush, a MTT assay was used to examine the viability of the epithelial cells collected from the oral cavity prior to and after the use of the toothbrush with the noted tissue cleanser. The MT Assay was based on the enzymatic reduction of the tetrazolium salt MTT [3-(4,5-dimethylthiazol-2-yl)-2,5-diphenyl-tetrazoliumbromide ++ +] in living, metabolically active cells. The reaction was carried out in situ in test tubes, and the reaction product, a purple-colored formazan soluble in dimethylsulfoxide, was measured colormetrically using a multiwell plate reader. Advantageously, the MT Assay offers a high degree of precision, ease of use, and suitability for the purpose for large scale chemosensitivity testing.

Following a 7-day washout period, the test subjects reported to a test site without prior eating, drinking, or performing oral hygiene. The test subjects provided salivary rinse samples by rinsing their oral cavity with 9 ml of sterile water for 10 seconds and then discharging the water from the rinse into a tube containing 10× sterile phosphate buffered saline(PBS) solution. The samples were refrigerated for approximately 30 minutes before the MTT Assay was run. The test subjects brushed their teeth under supervision for one minute using a fluoride dental cream (see Table 1) followed by 10 seconds of tongue cleaning with the tongue cleanser 300 of the preferred construction. Approximately 30 minutes after brushing and tongue cleaning, the test subjects provided a rinse sample in the manner described previously.

The pre-rinse samples and post-rinse samples were centrifuged for 15 minutes at about 3000 RPM. The supernatant, e.g., clear liquid, was removed and the pellet was resuspended in 2.5 mL of PBS. The samples were vortexed for 5 seconds, then 2.5 ml of MTT Solution was added. The samples were subsequently incubated in a gently shaking waterbath set at 37° C. for 2 hours. Following the 2 hour incubation period, the samples were centrifuged for 15 minutes at about 3000 RPM. The supernatant was siphoned out and 3 mL of detergent (0.04 N Acid Isopropanol) was added to dissolve purple crystals. An increase or decrease in MTT conversion was spectrophotometrically quantified. From each sample, 200 μl of each was added to 96 well plates and the optical density was measured at 570 nm and compared to a negative buffer control. In the illustrative example, one minute of brushing followed by 10 seconds of use of the tissue cleanser reduced oral epithelial cells about 72% as determined by a MTT assay protocol.

EXAMPLE 4

In another study, human test subjects provided baseline VSC samples via a Halimeter™ (i.e., a sulfide meter). A Halimeter™ uses an electrochemical, voltammetric sensor which generates a signal when it is exposed to VSC such as, sulfide and mercaptan gases and measures the concentration of hydrogen sulfide gas in parts per billion. The test subjects brushed their teeth under supervision for one minute with the preferred construction of a toothbrush having the above noted tissue cleanser. Then, the test subjects used the noted toothbrush to provide six strokes on the tongue surface. A subsequent VSC sample was taken from the test subjects two hours after the brushing stage. In this illustrative example, use of a toothbrush with the tissue cleanser reduced the measured VSC in the mouth odor over 35% from a baseline measured two hours after use.

EXAMPLE 5

In one other study, after a washout period, human test subjects rinsed their mouths with sterile water to provide a baseline sample for viable epithelial cell analysis with the MTT assay. The subjects brushed their teeth under supervision for one minute with the preferred construction of the toothbrush having the above-noted tissue cleanser. Then, the test subjects used the tissue cleanser to provide six strokes on the tongue surface. The test subjects provided a post rinse sample for analysis. The samples were tested and analyzed in the manner as discussed with respect to Example 3. In this example, use of the toothbrush reduced oral epithelial cells by about 92% from a baseline as determined by MTT assay protocol.

In the above noted examples, the subjects brushed their teeth using a fluoride dental cream with the formulation in Table 1.

TABLE 1

| % wt. | Ingredient |
|---|---|
| 48.76% | Dicalcium Phosphate Dihydrate |
| 22.0063% | Water |
| 22.00% | Glycerin |
| 4.138% | SO3 Sodium Lauryl Sulfate base - 29% |
| 1.000% | Sodium CMC - 7MF - Food Grade |

TABLE 1-continued

| % wt. | Ingredient |
|---|---|
| 0.89% | 105 Dental Cream Flavor |
| .76% | Sodium Monofluorophosphate |
| .25% | Tetrasodium Pyrophosphate |
| .20% | Sodium Saccharin |

What is claimed is:

1. An oral care implement comprising:

a head having a first surface, an opposite second surface, and sidewalls extending between the first and second surfaces;

a cleanser for cleansing soft tissue in the mouth, the cleanser being formed of a resilient material and including a base having a main portion fixed to the first surface and side portions fixed to the sidewalls, and at least one projection protruding outward from the base for removal of microbial and other debris from the soft tissue;

cleaning elements projecting from the second surface of the head and from the side portions of the base for acting on a user's teeth and gums;

wherein the cleaning elements projecting from the side portions are formed as one piece with the base;

wherein the base, the at least one projection, and the cleaning elements projecting from the side portions are formed of an elastomer; and wherein a plurality of said bases each in the form of an elongate strip are fixed to the head, each including a plurality of said projections.

2. An oral care implement comprising:

a head having a first surface, an opposite second surface, and sidewalls extending between the first and second surfaces;

a cleanser for cleansing soft tissue in the mouth, the cleanser comprising:

a base having a main portion fixed to the first surface;

side portions fixed to the sidewalls;

a plurality of projections protruding outward from the base for removal of microbial and other debris from the soft tissue; and a plurality of cleaning elements projecting from the side portions of the base for acting on a user's teeth and gums;

wherein the plurality of teeth cleaning elements projecting from the side portions are formed as one piece with the base;

wherein the base, the plurality of projections, and the plurality of cleaning elements projecting from the side portions are formed of an elastomer; and wherein the main portion is formed of a plurality of elongate strips and wherein each of the side portions is an extension of one of the elongate strips, each of the plurality of elongate strips including a plurality of said projections.

* * * * *